US005453573A

United States Patent [19]

Callas

[11] Patent Number: 5,453,573

[45] Date of Patent: Sep. 26, 1995

[54] ENGINE COOLING SYSTEM

[75] Inventor: James J. Callas, Peoria, Ill.

[73] Assignee: Caterpillar Inc., Peoria, Ill.

[21] Appl. No.: 279,604

[22] Filed: Jul. 25, 1994

[51] Int. Cl.[6] ..... F01P 3/02

[52] U.S. Cl. ..... 123/41.73; 123/41.28; 123/41.77

[58] Field of Search ..... 123/41.28, 41.73, 123/41.77, 41.79

[56] References Cited

U.S. PATENT DOCUMENTS

| | | | |
|---|---|---|---|
| 1,793,713 | 2/1931 | Morrill | 123/41.28 |
| 1,845,521 | 2/1932 | Ross . | |
| 1,968,449 | 7/1934 | Hefti | 123/173 |
| 2,078,499 | 4/1937 | Ljungström | 123/41.77 |
| 2,146,368 | 2/1939 | Dake | 123/173 |
| 2,411,924 | 12/1946 | Kratzer | 123/173 |
| 3,086,505 | 4/1963 | Bovard | 123/41.8 |
| 3,481,316 | 12/1969 | Olson et al. | 123/41.84 |
| 3,641,882 | 2/1972 | Hall | 92/171 |
| 3,672,263 | 6/1972 | Mirjanic | 92/144 |
| 3,800,751 | 4/1974 | Glassey et al. | 123/41.84 |
| 4,050,421 | 9/1977 | Cendak | 123/41.72 |
| 4,638,769 | 1/1987 | Ballheimer | 123/41.84 |

FOREIGN PATENT DOCUMENTS

| | | |
|---|---|---|
| 0094982 | 8/1986 | European Pat. Off. . |
| 969880 | 7/1958 | Germany . |
| 1597584 | 12/1977 | Switzerland . |
| 2021691 | 12/1979 | United Kingdom . |

OTHER PUBLICATIONS

Article "Deere Upgrades Engines For The Open Market" publ. Diesel Progress Engines & Drives, pp. 40–44.

Article "Forced Convection Jets of Air Impinging On A Surface", Genium Publishing, Jan. 1968, Section 503.6 pp. 1–8.

*Primary Examiner*—Noah P. Kamen

*Attorney, Agent, or Firm*—Diana L. Charlton

[57] ABSTRACT

During operation of an internal combustion engine, structures adjacent the piston top ring turn around position and the exhaust port are exposed to high temperatures. In order to improve cooling around these adjacent structures, the heat transfer coefficient must be increased. In this manner, energy around the top ring turn around position on the cylinder liner and around the exhaust seat can be transferred through a cooling liquid and away from the adjacent structures. The present invention enhances the cooling capability within an engine by utilizing a flow controlling device disposed between a cooling liquid inlet chamber and a cylinder liner. The flow controlling device has a plurality of orifices therein. A cooling liquid from a pressurized source is communicated to the inlet chamber and passes through the plurality of orifices to impinge a predetermined peripheral portion of the cylinder liner adjacent an exhaust port. Due to the small size of the orifices, the velocity of the cooling liquid is increased as it passes therethrough. The increased velocity of the cooling liquid and the subsequent impingement upon a required, selected portion of the cylinder liner increases the overall cooling effectiveness.

21 Claims, 7 Drawing Sheets

ENGINE COOLING SYSTEM

TECHNICAL FIELD

This invention relates generally to engine cooling systems and more particularly to a liquid cooling system for enhanced cooling of selected areas of an engine cylinder liner.

BACKGROUND ART

Combustion of compressed air and fuel in the cylinders of internal combustion engines adds large amounts of heat to the axially outer areas of the cylinder liner and engine structure surrounding the cylinders. The structures, normally called the head, closing the axially outer end of the cylinder liner normally includes intake and exhaust passages communicating with the combustion chambers. These passages permit the ingress of air to the combustion chamber and egress of hot exhaust gas after combustion of a fuel-air mixture. Intake valves are normally located in the intake passages to control admission of the air to the combustion chamber. Likewise, an exhaust valve is located in the exhaust passage or passages to permit venting of the hot exhaust gas during the scavenge stroke of the piston. Due to the arrangement of the intake and exhaust valves in the structure, the exhaust passage or passages are located adjacent a particular circumferential area of the cylinder liner.

As the hot exhaust gas exits the cylinder through the exhaust passage, the head structure and the circumferential area of the cylinder liner adjacent the exhaust passage absorbs additional energy. This creates what is commonly referred to as a "hot spot", resulting in a considerable temperature gradient circumferentially around the liner. The temperature gradient can result in distortion of the liner, resulting in an imperfect seal with sealing rings carried by the piston, with attendant, undesirable increase in blowby and/or increased oil consumption.

In many instances, the combustion energy propagates to an area of the liner where the axially outer sealing ring of a piston stops when the piston is in its axially outermost position. This establishes what is commonly referred to as a "top ring turn around position" on the cylinder liner. Excessive temperature in the area of the liner can result in coking of oil and sticking of the rings in the mating grooves in the pistons. Sticking of the rings can produce excessive blowby; ie, combustion pressure in the crankcase, and/or excessive oil consumption, as well as possible excessive wear of the rings and cylinder liner.

It is desirable that a cooling system be provided to cool the top ring turn around position area of a cylinder liner to avoid coking of oil in the ring groove and attendant ring sticking. It is also desirable to provide enhanced cooling of cylinder liners in the area of the exhaust ports to achieve a more consistent temperature gradient around the liner to reduce distortion thereof and minimize the resultant problems. Further, it is desirable to cool only those areas of the engine that specifically need cooling to avoid other thermal gradients and lessen the heat load on the heat exchangers.

The present invention is directed at overcoming the problems as set forth above.

Disclosure of the Invention

In one aspect of the present invention, an engine cooling system is disclosed including an engine which has a cylinder housing with an open ended bore defined therein. An annular cylinder liner is mounted in the bore. A piston is mounted for reciprocation in the annular cylinder liner and has at least one sealing ring mounted therearound for sealing engagement with the annular cylinder liner. The piston defines a top ring turn around position when at its outermost position as it reciprocates in the annular cylinder liner. A head is mounted in closing relation to an end of the annular cylinder liner adjacent the top ring turn around position and forms, with the piston, a combustion chamber in the annular cylinder liner. The head defines an intake port and an exhaust port communicating with the combustion chamber. The exhaust port is disposed adjacent a predetermined peripheral portion of the annular liner. An intake valve is operatively associated with the intake port and the combustion chamber. An exhaust valve is operatively associated with the exhaust port and the combustion chamber. The engine cooling system comprises a source of pressurized cooling liquid and a cooling liquid inlet chamber is defined in the cylinder housing which is in communication with the source. A cooling liquid flow path is defined between the cylinder housing and the annular cylinder liner in circumscribing relation around the axially outermost portion of the annular cylinder liner in substantial radial overlying relation with the top ring turn around position. The cooling liquid flow path communicates with the cooling liquid inlet chamber. The cylinder housing includes a flow controlling orifice device disposed between the cooling liquid inlet chamber and the cooling liquid flow path with a portion operative to direct cooling liquid at a relatively high velocity from the cooling liquid inlet chamber into the cooling liquid flow path for impingement on the predetermined peripheral portion of the annular cylinder liner located adjacent the exhaust port.

The present invention, through the use of a flow controlling device, provides a means for increasing the velocity of a cooling fluid passing from a cooling liquid inlet chamber into a cooling liquid flow path. The cooling liquid impinges a predetermined peripheral portion of a cylinder liner at a relatively high velocity to improve the cooling capability of the engine.

BEST MODE FOR CARRYING OUT THE INVENTION

Figure 1:
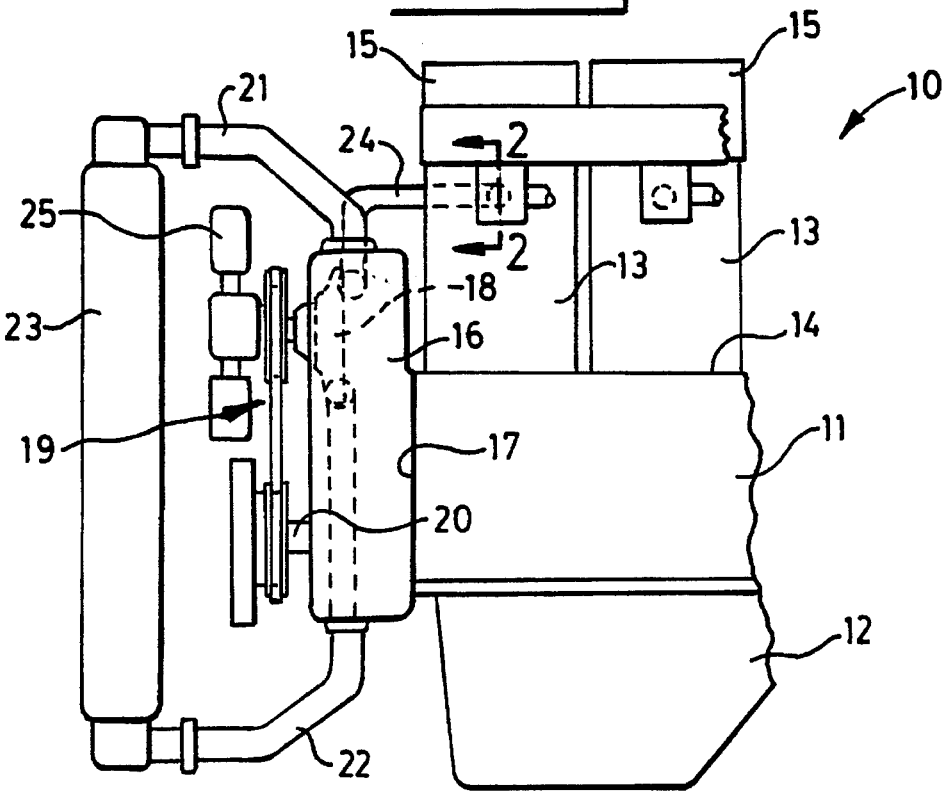
FIG. 1 is a side elevational view of the front portion of an engine and cooling system therefor including an embodiment of the present invention.

Referring now to the drawings and in particular FIG. 1, a multi-cylinder engine 10 includes a lower block member 11 having a conventional oil pan 12 secured to a lower edge thereof in a conventional manner. The oil contained within the oil pan 12 is circulated through the engine 10 by a conventional oil pump (not shown). A plurality of cylinder housings 13 are secured to an upper edge 14 of the lower block member 11 with an axially outer end thereof closed by a like number of cylinder heads 15. An auxiliary drive housing 16 is secured to a front face 17 of the lower block member 11 and includes a water pump 18 driven by a belt and pulley mechanism 19 from an extension of the engine crankshaft 20. The water pump 18 is connected through upper and lower hoses 21, 22, respectively, for circulating a cooling fluid through a conventional heat exchanger 23 in a well known manner. A water pump outlet line 24 allows cooling fluid to pass from the heat exchanger 23 through the cylinder housing 13.

Figure 3:
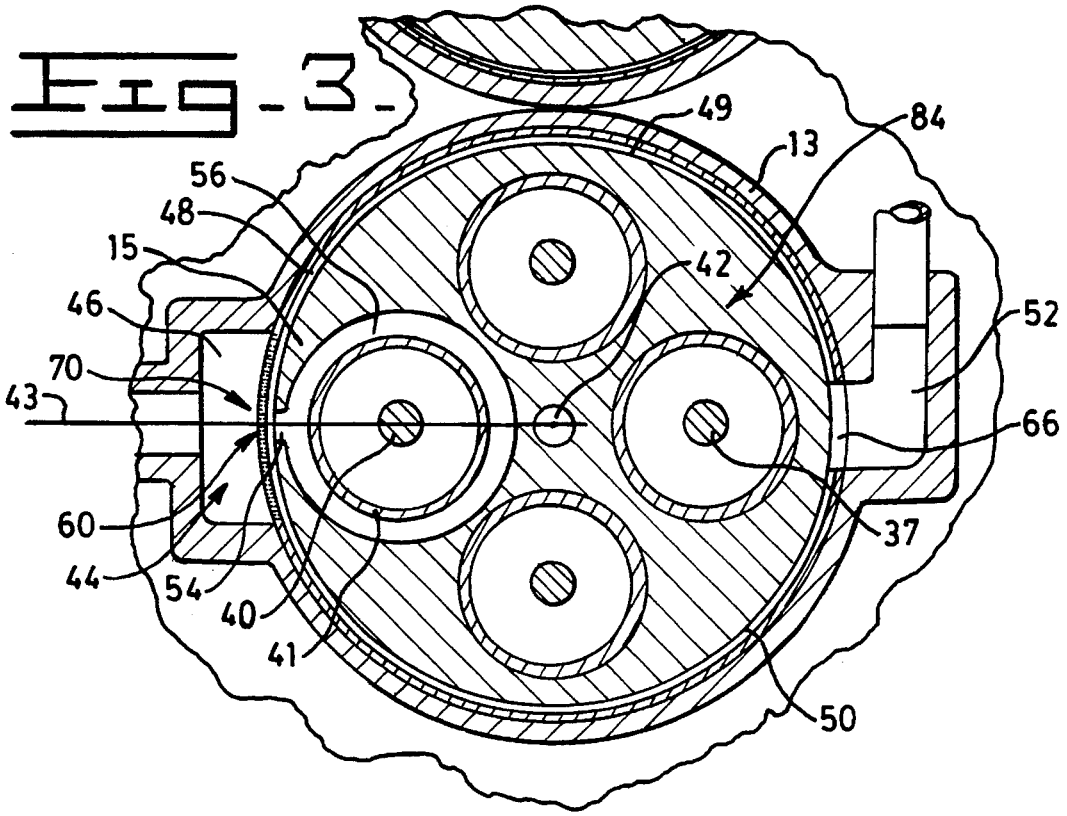
FIG. 3 is a horizontal cross-sectional view of a portion of the engine taken along line 3—3 of FIG. 2 illustrating the embodiment of FIG. 1 of the present invention.
Figure 2:
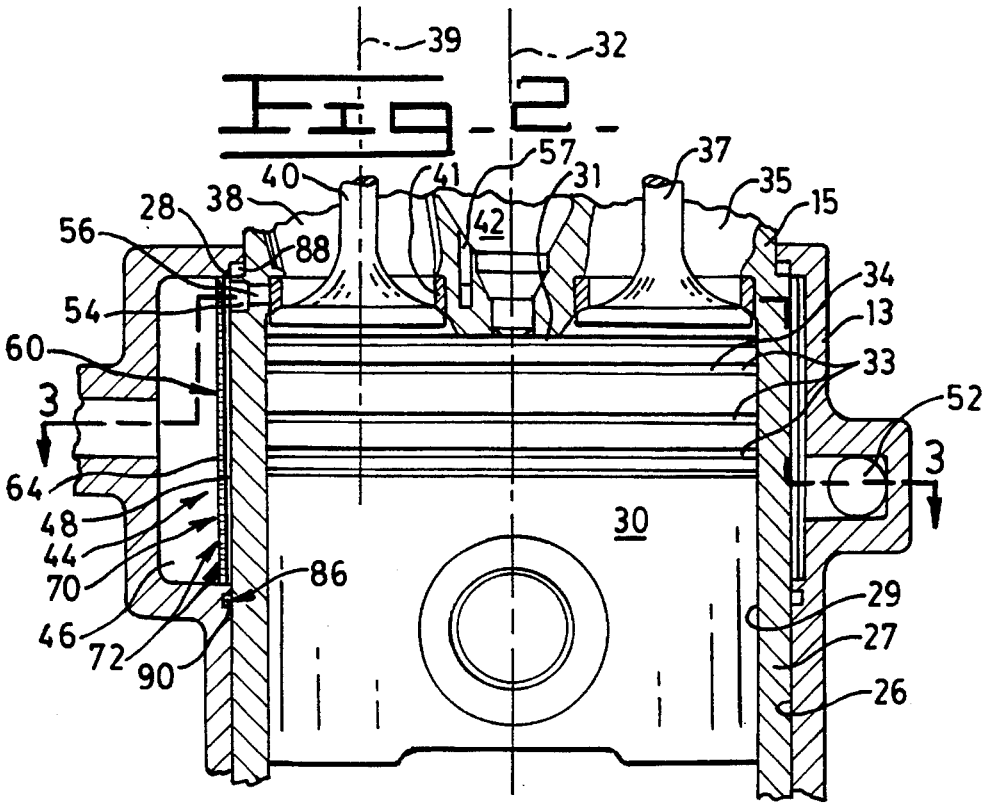
FIG. 2 is a vertical cross-sectional view of one cylinder taken along line 2—2 of FIG. 1 of the present invention.

As is best shown in FIGS. 2 and 3, the cylinder housings 13 each include a bore 26 which is adapted to receive a cylinder liner 27 inwardly formed with the cylinder head 15. The cylinder liner 27 has an axial outermost end 28 adjacent the cylinder housing 13. The cylinder liner 27 provides a cylinder bore 29 adapted to reciprocatably receive an engine piston 30 which forms, with the head 15, a variable volume combustion chamber 31. The piston 30 has an axis 32 and includes a plurality of seal rings 33 for sealing the piston 30 within the cylinder bore 29 in a conventional manner. The seal rings 33 include a top ring 34 which defines a top ring turn around position when the piston 30 is reciprocated to a conventional top dead center (TDC) location within the cylinder liner 27.

The head 15 includes an intake port 35 for emitting air to the combustion chamber 31. An intake valve 37 is adapted to seat at the terminal end of the intake port 35 for regulating the admission of air to the combustion chamber 31. An exhaust port 38 also has a terminal end communicating with the combustion chamber 31 for expulsion of exhaust gases from the combustion chamber 31. The exhaust port 38 has a centerline 39 and is located adjacent a predetermined peripheral portion of the cylinder liner 27. An exhaust valve 40 seats at the terminal end of the exhaust port 38 against an exhaust valve seat 41 to control the expulsion of exhaust gases from the combustion chamber 31. A fuel injector 42 is mounted within the head in a conventional manner for injecting fuel into the combustion chamber 31 at an appropriate time to create a combustible mixture with the air provided through the intake port 35. The centerline 39 of the exhaust port 38 and the axis 32 of the piston 30 define a plane 43 which bisects the exhaust port 38.

An engine cooling system 44 communicates a cooling liquid, such as oil, from the oil pan 12 via a oil pump of conventional design (not shown) and a series of passages (not shown) to an area in close proximity to the exhaust port 38. A cooling liquid inlet chamber 46 is defined within the cylinder housing 13 and is fluidly connected to the oil pan 12 through the series of passages (not shown). It should be understood that the cooling liquid could be a coolant, such as water or an ethylene glycol mixture, circulated from the radiator 23 and into the cooling liquid inlet chamber 46.

A primary cooling liquid flow path 48 circumferentially surrounds the cylinder liner 27 and communicates with the cooling liquid inlet chamber 46 defined within the cylinder liner 27. The primary cooling liquid flow path 48 is defined between the cylinder housing 13 and the cylinder liner 27 in circumscribing relation around the axially outermost end 28 of the cylinder liner 27 in substantially radial overlying relation with the top ring turn around position. The primary cooling liquid flow path 48 includes a pair of flow segments 49,50 diverging equally on either side of the plane 43 and terminating within an outlet port 52 defined within the cylinder housing 13. The pair of flow segments 49,50 have a combined cross-sectional area substantially equal to the cross-sectional area of the outlet port 52. A secondary cooling liquid flow path 56 defined within the cylinder head 15 circumferentially surrounds and is adjacent to the exhaust valve seat 41 and communicates with the primary cooling liquid flow path 48 through an opening 54. A plurality of cooling liquid passages, such as the one shown at 57, communicate between the secondary cooling liquid flow path 56 and the cylinder head 15.

Figure 4:
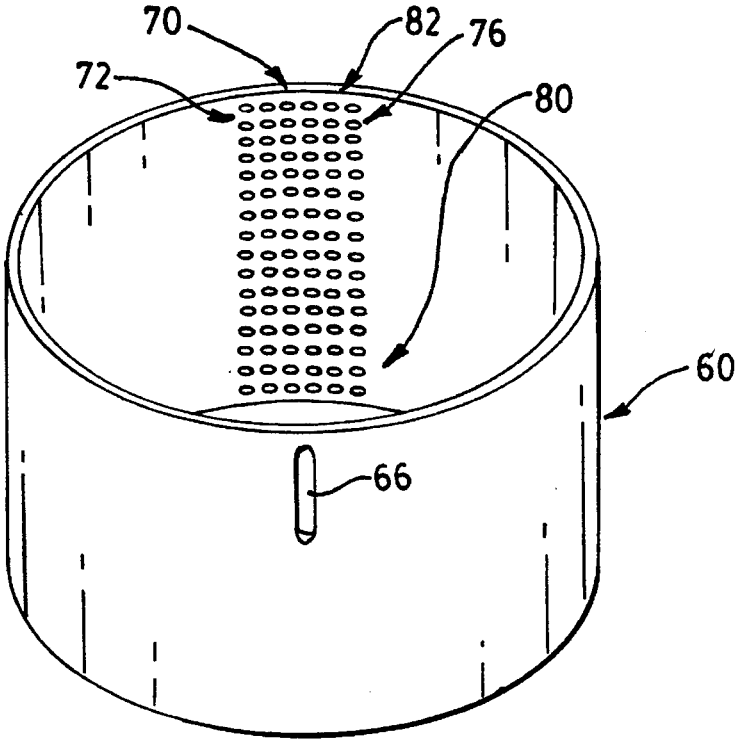
FIG. 4 is a perspective view of the flow controlling device for the embodiments shown in FIGS. 2 and 3.
Figure 5:
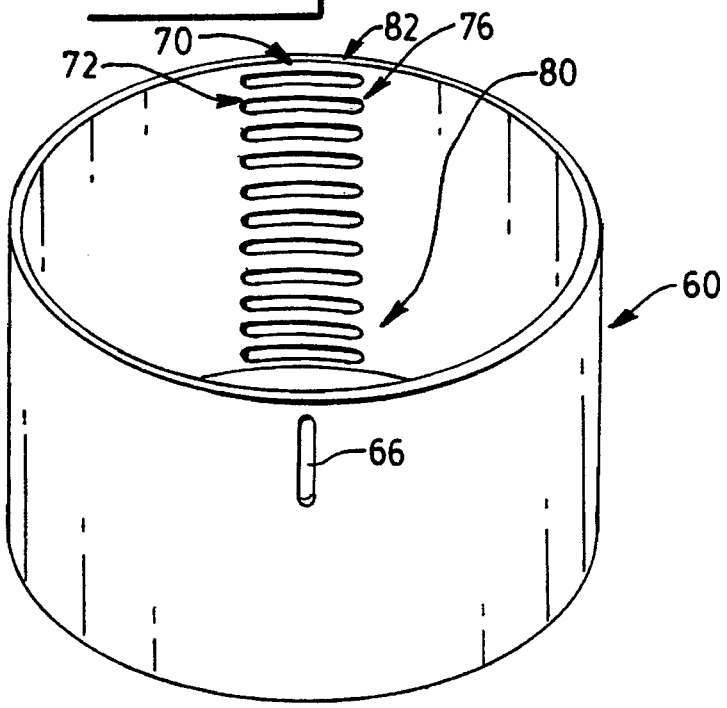
FIG. 5 is a perspective view of another embodiment of the flow controlling device.

A flow controlling device 60 is located within the cylinder housing 13 and is disposed between the cooling liquid inlet chamber 46 and the cylinder liner 27. The flow controlling device 60 is a ring member 64 mounted in the cylinder housing 13 in radially spaced, circumscribing relation to the cylinder liner 27 to define with the cylinder liner 27 the primary cooling liquid flow path 48. The ring member 64 is substantially concentric with the cylinder liner 27. A slotted opening 66 is defined within the ring member 64 in substantial circumferential alignment with the outlet port 52. Referring more specifically to FIGS. 4 and 5, a portion of the flow controlling device 60 includes a predetermined plurality of orifices 70. The orifices 70 may be of any suitable shape, such as circular, slotted, etc.. The plurality of orifices 70 are arranged in a plurality of rows 72 to define an array 76. The array 76 is located substantially diametrically opposite the outlet port 52. The plurality of rows 72 has an innermost row portion 80 located a predetermined axial distance inwardly from the top ring turn around position. The plurality of rows 72 extends upwardly from the top ring turn around position toward the cylinder head 15 terminating at an outermost row portion 82 located substantially within a flame deck area 84 of the cylinder head 15. The array 76 has a predetermined minimum height of 8 mm. The array 76 has a predetermined maximum width substantially equal to the width of the cooling liquid inlet chamber 46. The circumferential width of the array is generally not more than 90 degrees on either side of the plane 43. It should be noted that the ring member 64 is positioned so that the communication of cooling liquid between the cooling liquid inlet chamber 46 and the primary cooling liquid flow path 48 is blocked except through the orifices 70. It should also be noted that the array 76 may be arranged in any suitable geometric configuration, such as rectangular, triangular, etc., without changing the scope of the present invention.

Referring again to FIG. 2, a sealing means 86 is disposed within the cylinder housing 13 to sealingly engage the cylinder liner 27 and the cylinder housing 13. The sealing means 86 includes a first annular seal 88 located adjacent the axially outermost end of the cylinder liner 27. A second annular seal 90 is located axially inwardly toward the crankshaft 20 from the first annular seal 88. The first and second annular seals 88,90 define the axially outer and inner edges of the cooling liquid flow path 48, respectively.

Figure 7:
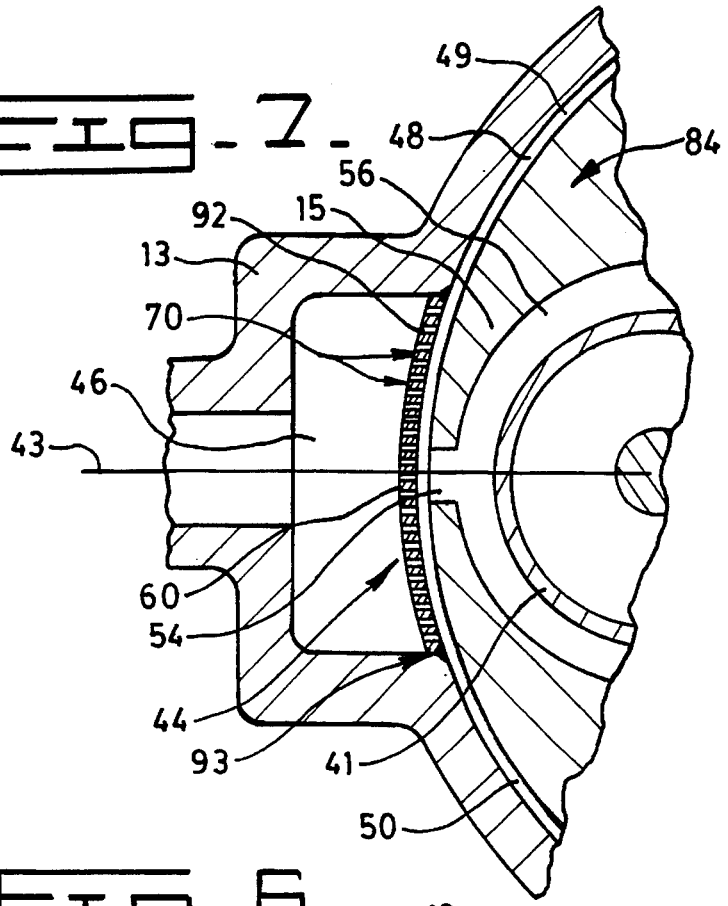
FIG. 7 is a horizontal cross-sectional view taken along line 6—6 of FIG. 6.
Figure 6:
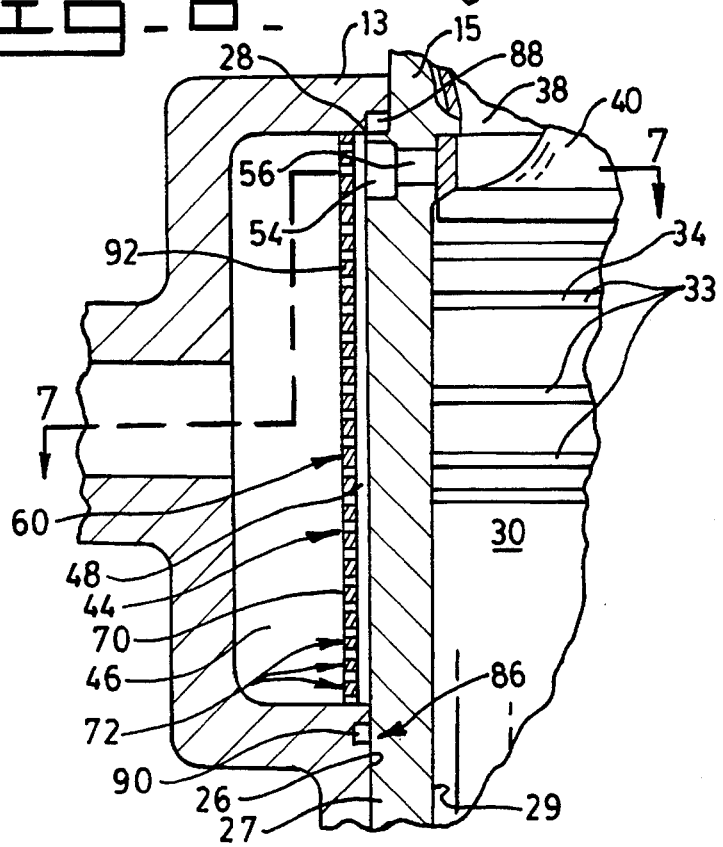
FIG. 6 is an enlarged, partial cross-sectional view similar to the left portion of FIG. 2 illustrating an alternate embodiment of the present invention.

Another embodiment of the present invention is shown in FIGS. 6 and 7. It should be understood that the same reference numerals of the first embodiment are used to designate similarly constructed counterpart elements of this embodiment.

Referring now to FIGS. 6 and 7, the flow controlling device 60 is an arcuate member 92. A means for securing 93 the arcuate member 92 to the cylinder housing 13, such as welding, is shown in FIG. 6. However, it should be understood that any suitable means for securing the arcuate member 92 to the cylinder housing 13 could be used, such as any well-known fastening device. The arcuate member 92 has the plurality of orifices 70 shown in the embodiment of FIGS. 2–5. The primary cooling liquid flow path 48 is defined between the arcuate member 92 and the cylinder liner 27 along the circumferential width of the cooling liquid inlet chamber 46 and between the cylinder housing 13 and the cylinder liner 27 substantially across the remaining perimeter of the cylinder liner 27. The arcuate member 92 is positioned to substantially block the cooling liquid communication from the cooling liquid inlet chamber 46 to the primary cooling liquid flow path 48 except through the orifices 70.

An alternate engine design is shown in FIGS. 8–12 embodying the present invention. It should be understood that the same reference numerals of the first engine design shown in FIGS. 1–7 are used to designate similarly constructed counterpart elements of this embodiment.

Figure 8:
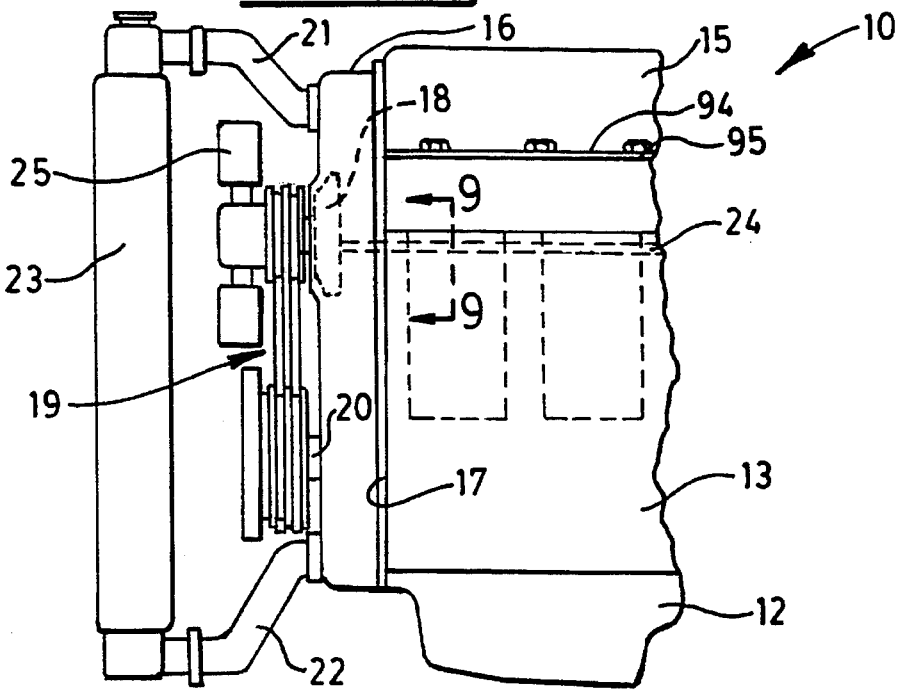
FIG. 8 is a side elevational view of the front portion of an alternate engine design and cooling system therefor including an embodiment of the present invention similar to that shown in FIGS. 2 and 3.

In FIG. 8, the cylinder head 15 is removably connected to an upper edge 94 of the cylinder housing 13 and is a separate component. The auxiliary drive housing 16 is secured to the front face 17 of the cylinder housing 13. A gasket 95 is disposed between the cylinder head 15 and axially outermost end of the cylinder housing 13. The gasket 95 has an opening 96 therethrough to allow communication of cooling liquid from the cooling inlet chamber 46 into a plurality of cooling passages (not shown) in the cylinder head 15.

Figure 10:
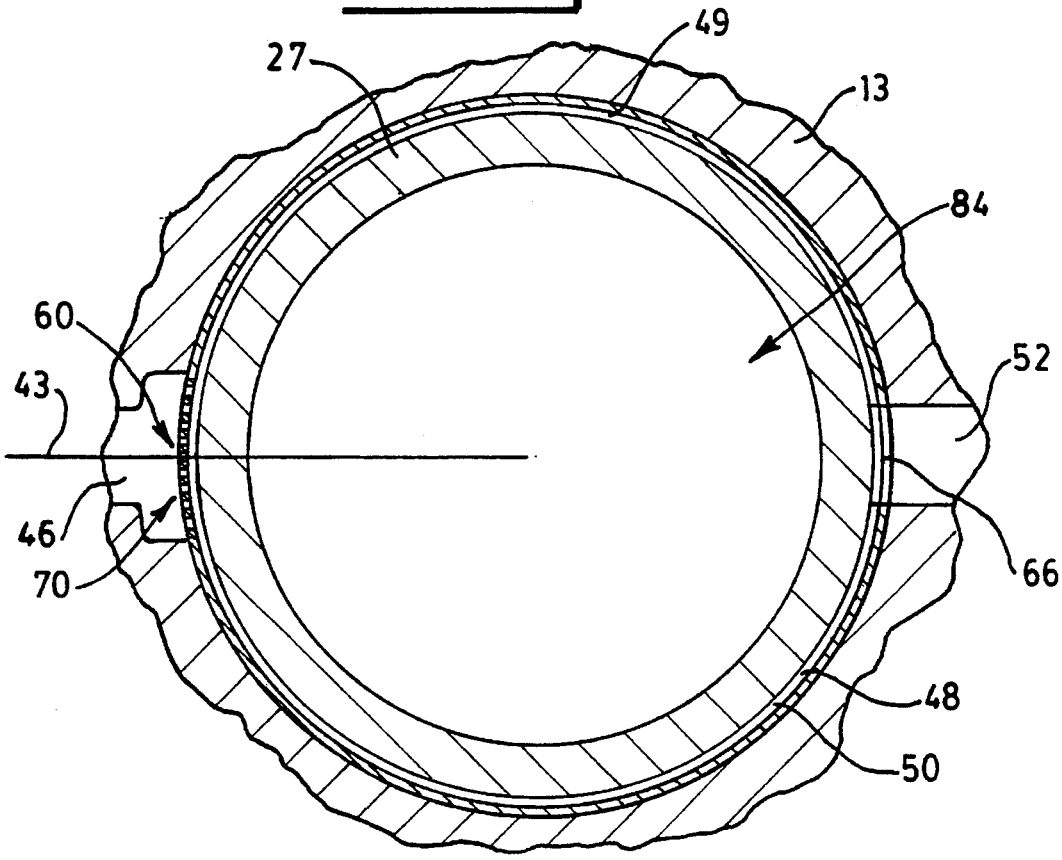
FIG. 10 is a horizontal cross-sectional view taken along line 9—9 of FIG. 9.
Figure 9:
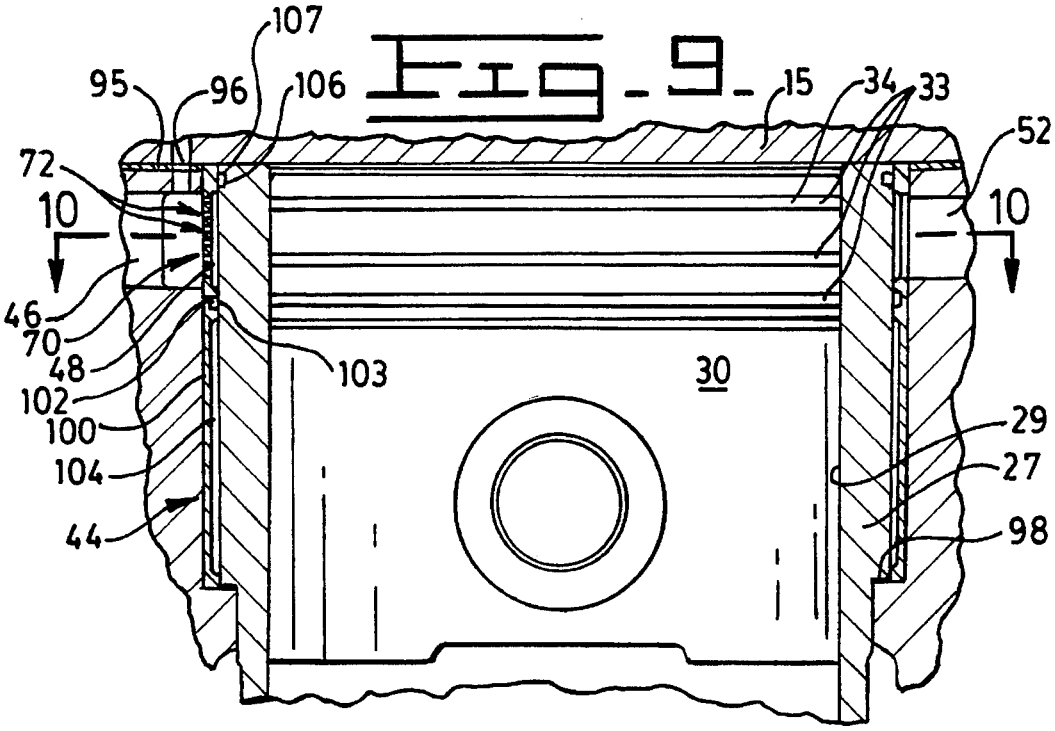
FIG. 9 is a fragmentary vertical cross-sectional view of a portion of one cylinder taken along line 8—8 of FIG. 8 illustrating another alternative embodiment of the present invention.

Referring more specifically to FIGS. 9 and 10, the cylinder liner 27 is supported substantially midway against an annular shoulder 98 in the cylinder housing 13. The flow controlling device 60 is an annular ring member 100 mounted in the cylinder housing 13 in radially spaced, circumscribing relation to the cylinder liner 27. The annular ring member 100 includes an inner, annular groove 102 therearound with an inner seal 103 disposed therein. An air gap 104 is located axially inwardly of the inner seal 103 and is defined between the cylinder liner 27 and the annular ring member 100. The inner seal 103 sealingly separates the cooling liquid flow path 48 from the air gap 104. The annular ring member 100 includes an outer, annular groove 106 therearound located substantially at the axially outermost end of the annular ring member 100 adjacent the axially outermost end of the cylinder liner 27. An outer seal 107 is disposed within the outer groove 106. The inner seal 103 and the outer seal 107 define the inner and outer edges of the coolant flow path 48, respectively. The plurality of orifices 70 extend from the inner groove 102 upwardly toward the flame deck area 84 of the cylinder head 15. The innermost row 80 of the orifices 70 is located axially inwardly of the top ring turn around position by no more than 15 mm.

Figure 12:
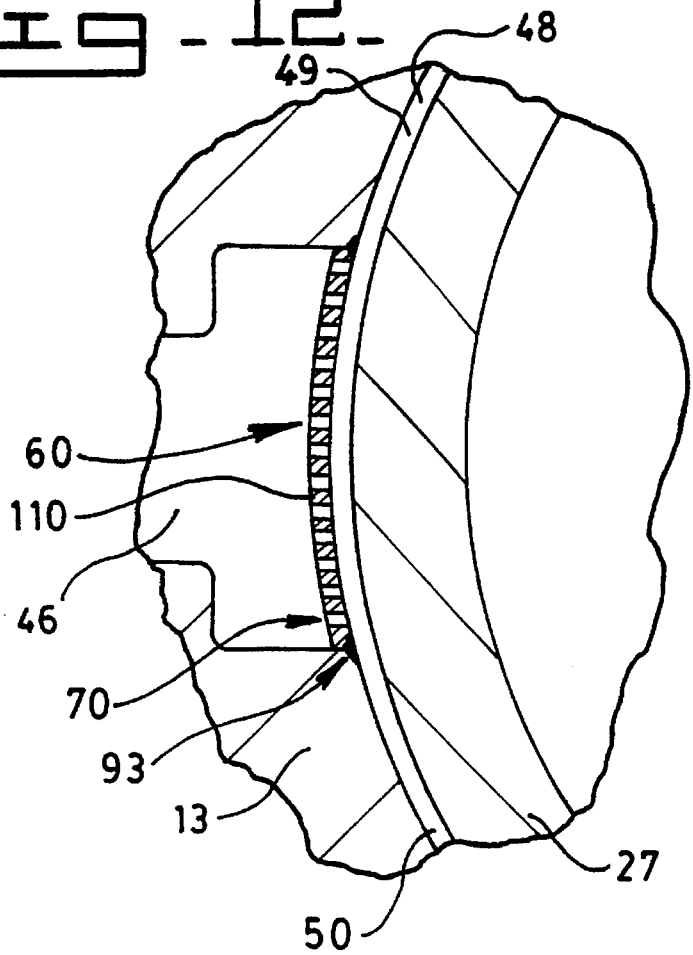
FIG. 12 is a horizontal cross-sectional view taken along line 11—11 of FIG. 11.
Figure 11:
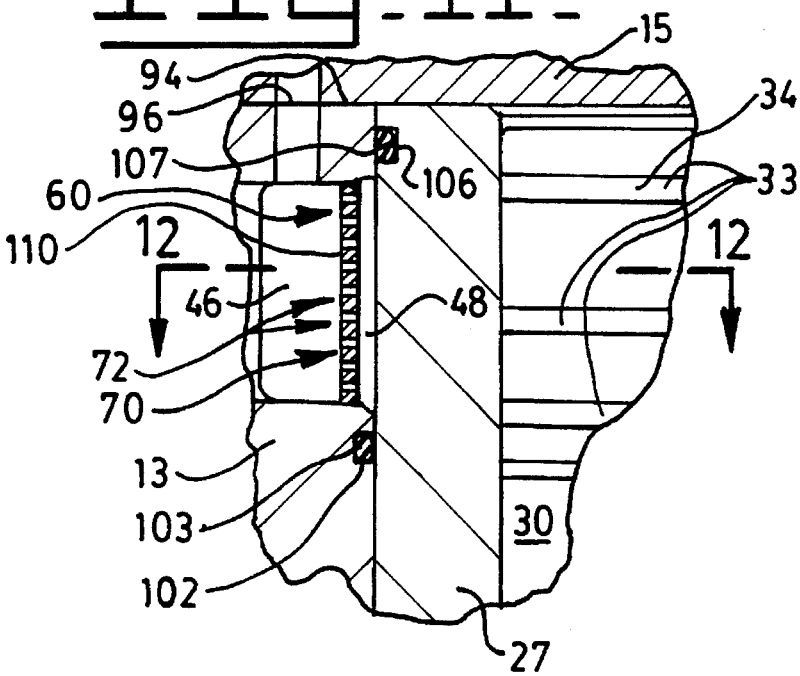
FIG. 11 is an enlarged, partial cross-sectional view similar to the upper left portion of FIG. 9 illustrating yet another alternative embodiment of the present invention.

Another embodiment of the present invention is shown in FIGS. 11 and 12. It should be understood that the same reference numerals of the first embodiment of the alternate engine design are used to designate similarly constructed counterpart elements of this embodiment.

Referring now to FIGS. 11 and 12, the flow controlling device 60 includes an arcuate member 110 which is secured within the cooling liquid inlet chamber 46 in a manner similar to the arcuate member 92 shown in FIGS. 6 and 7.

Figure 13:
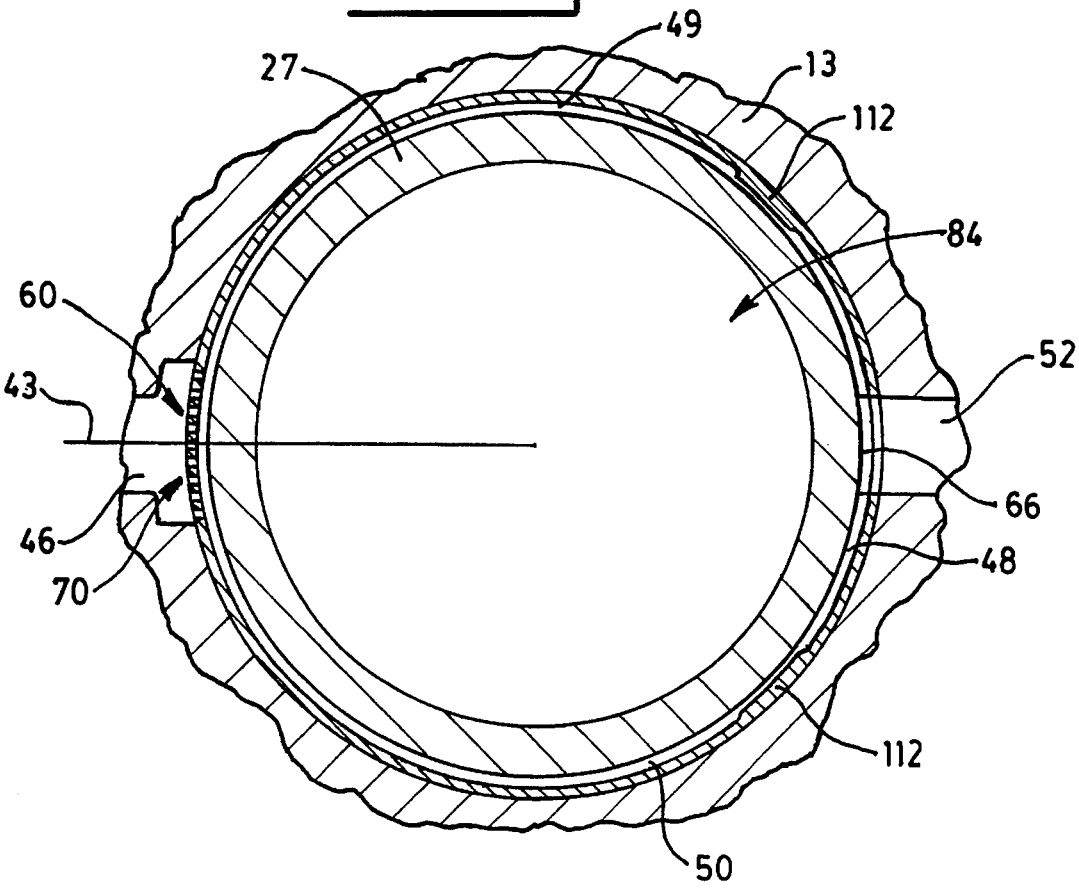
FIG. 13 is a horizontal cross-sectional view illustrating still another alternate embodiment of the present invention.
Figure 14:
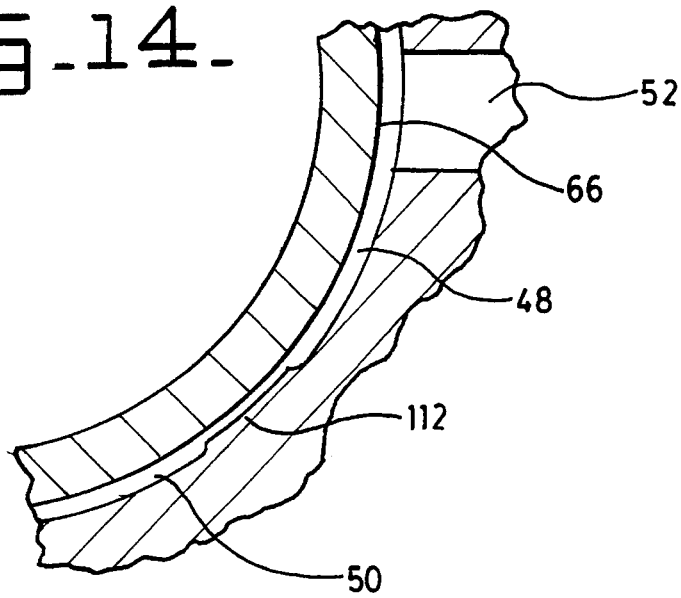
FIG. 14 is a fragmentary, horizontal cross-sectional view combining the embodiment of FIG. 13 with that of FIG. 12.

Other embodiments of the present invention are shown in FIGS. 13 and 14. It should be understood that the same reference numerals of the first embodiment of the alternate engine design are used to designate similarly constructed counterpart elements of this embodiment.

In FIG. 13, a pair of protuberances 112 project into the cooling liquid flow path 48 at a predetermined location downstream of the cooling liquid inlet chamber 46 to reduce the cross-sectional area of the cooling liquid flow path 48. The pair of protuberances 112 extend from the ring member 100 and are operatively associated with the cylinder liner 27. It should be understood that the protuberance 112 could be similarly utilized with the engine configuration having the ring member 64.

In FIG. 14, the pair of protuberances 112 extend from the cylinder lining 27. It should be understood that the protuberances 112 could be similarly utilized with the engine configuration shown in FIGS. 6–7 with the protuberances 112 extending from the cylinder housing 13.

Industrial Applicability

In use on an engine 10 having an integral cylinder head 15 and cylinder liner 27, such as that shown in FIGS. 1–7, pressurized cooling liquid from the oil pan 12 is circulated to the cooling liquid inlet chamber 46 by the oil pump (not shown) through a series of passages (not shown). It should be understood that any suitable pressurized cooling liquid, such as water, an ethylene glycol mixture, etc. from the heat exchanger 23 could be alternatively circulated to the cooling liquid inlet chamber 46 by the water pump 18 through the series of passages (not shown).

The oil enters the cooling liquid inlet chamber 46 at a pressure sufficient to pass through the plurality of circular orifices 70 in the flow controlling device 60. Due to the small size of the orifices 70, the velocity of the oil is increased as it passes from the cooling liquid inlet chamber 46 and through the orifices 70. The oil, at the increased velocity, impinges against the portion of the cylinder liner 27 which is adjacent the exhaust port 38. The orifices 70 should maintain a circumferential width of not more than 180 degrees so that impingement upon the cylinder liner 27 is controllably directed for maximum cooling effectiveness. Additionally, the oil should impinge on the cylinder liner 27 at a predetermined height sufficient to substantially circumferentially overly the top ring turn around position with at least one of the plurality of orifices 70 located outwardly therefrom. The rectangular array of orifices 76 has a minimum height of 8 mm and a maximum height of 80 mm. However, adequate cooling is achieved when the orifices 70 extend no more than 15 mm axially inwardly from the top ring turn around position. It should be understood that it is preferable that the height of the rectangular array of orifices 70 is sufficient to extend well into the flame deck area 84 from a position axially inwardly from the top ring turn around position in order to achieve maximum cooling effectiveness. Since the orifices 70 of flow controlling device 60 are the only communication between the cooling liquid inlet chamber 46 and the primary cooling liquid flow path 48, virtually all of the oil impinges the cylinder liner 27 at a relatively high velocity. The high velocity of the oil and the subsequent impingement against the cylinder liner 27 increases the overall cooling effectiveness of the cooling system 44. The increased velocity during impingement increases the heat transfer coefficient so that more energy is removed per unit area and per unit mass flow. It should be understood that if the pressurized cooling fluid used were water, ethylene glycol, etc., due to the physical properties thereof, an acceptable increased heat transfer coefficient could be achieved through the use of slotted, elongated orifices 76. The slotted, elongated orifices 76 would allow the water or ethylene glycol to reach a velocity sufficient for increasing the heat transfer coefficient to an acceptable level.

As the oil enters the primary cooling liquid flow path 48, it is substantially equally divided to flow divergently on either side of the plane 43 into the flow segments 49,50 to substantially circumscribe the axially outermost portion 28 of the cylinder liner 27.

The oil exits the primary cooling liquid flow path 48 through the slotted opening 66 in the flow controlling device 60 and enters the outlet port 52. However, it should be understood that if the flow controlling device 60 is the arcuate member 92, the oil exits the primary cooling liquid flow path 48 by directly entering the outlet port 52. The outlet port 52 is connected to the oil pan 12 through a series of passages (not shown) so that the oil is returned thereto.

A portion of the oil impinging on the cylinder liner 27 enters the secondary cooling liquid flow path 56 through the opening 54. The oil encircles the exhaust valve seat 41. The cooling liquid passages 57 allows the oil to flow around the injector 42 and the exhaust valve guide (not shown) for further cooling . The oil is then communicated to the top of the cylinder head 15 where it is returned, by a series of passages (not shown) to the oil pan. It should be understood that if the pressurized cooling liquid used were water or ethylene glycol that the cooling liquid would return to the heat exchanger 23.

In use on an engine 10 having a separate cylinder head 15 and cylinder liner 27, such as that shown in FIGS. 8–13, the primary cooling liquid flow path 48 extends between the seals 103,107. The air gap 104 is provided to assist in the cooling process and for ease of manufacturability.

The protuberance 112, shown in FIGS. 13 and 14, provides a means within the primary cooling liquid flow path 48 for increasing the cooling potential at specific locations around the cylinder liner 27. Typically, "hot spots" may occur around the cylinder liner 27 during engine operation. The velocity of the oil is increased due to the decrease in cross-sectional area created by the protuberance 112 within the primary cooling liquid flow path 48. The increased oil velocity around the cylinder liner 27 created by the protuberance 112 allows for greater cooling effectiveness at specific locations. It should be understood that the protuberance 112 can be used in the engine configuration shown in FIGS. 1–7.

In view of the above, since improved cooling increases the performance of the engine, the present invention provides a means for increasing the heat transfer coefficient and, therefore, the cooling capability of an engine with less cooling liquid flow. The present invention utilizes a flow controlling device having a plurality of orifices therein. Pressurized cooling liquid from a source enters a cooling liquid inlet chamber and passes through the orifices to impinge upon a predetermined portion of a cylinder liner. The increase in the velocity across the orifices increases the cooling effectiveness of the system. The cooling liquid circumscribes the cylinder liner within a primary cooling liquid flow path. Additionally, the present invention provides a means for improved cooling around an exhaust port. A portion of the cooling liquid passes through an opening to enter a secondary cooling liquid flow path encircling the exhaust seat.

I claim:

1. An engine cooling system including an engine having a cylinder housing with an open ended bore defined therein, an annular cylinder liner mounted in the bore, a piston mounted for reciprocation in the annular cylinder liner and having at least one sealing ring mounted therearound for sealing engagement with the annular cylinder liner and defining a top ring turn around position when the piston is at its outermost position as it reciprocates in the annular cylinder liner, a head mounted in closing relation to an end of the annular cylinder liner adjacent the top ring turn around position and forming, with the piston, a combustion chamber in the annular cylinder liner, the head defining an intake port and an exhaust port communicating with the combustion chamber, the exhaust port being disposed adjacent a predetermined peripheral portion of the annular liner, an intake valve operatively associated with the intake port and the combustion chamber, an exhaust valve operatively associated with the exhaust port and the combustion chamber, the engine cooling system, comprising:

a source of pressurized cooling liquid;

a cooling liquid inlet chamber defined in the cylinder housing and in communication with the source;

a cooling liquid flow path defined between the cylinder housing and the annular cylinder liner in circumscribing relation around an axially outermost end of the annular cylinder liner in substantial circumferential overlying relation with the top ring turn around position and in communication with the cooling liquid inlet chamber; and the cylinder housing includes a flow controlling orifice device disposed between the cooling liquid inlet chamber and the cooling liquid flow path and having a portion operative to direct cooling liquid at a relatively high velocity from the cooling liquid inlet chamber into the cooling liquid flow path for impingement on the predetermined peripheral portion of the annular cylinder liner located adjacent the exhaust port.

2. The engine cooling system of claim 1, wherein the exhaust port has a centerline defined at the point of intersection with the combustion chamber, the piston has an axis, and a plane is defined through the exhaust port centerline and the piston axis with the portion of the flow controlling orifice device directing the cooling liquid circumferentially and substantially equally distributing the cooling liquid on opposite sides of the plane for impingement on the predetermined peripheral portion of the annular cylinder liner.

3. The engine cooling system of claim 2, including an annular seal for sealing engagement between the annular cylinder liner and the cylinder housing at a location adjacent the axially outermost end of the annular cylinder and another annular seal for sealing engagement between the annular cylinder liner and the cylinder housing at a location disposed axially inwardly from the location adjacent the outermost end thereof.

4. The engine cooling system of claim 3, wherein the annular seal and the another annular seal define the axially inner and outer edges of the cooling liquid flow path.

5. The engine cooling system of claim 4, wherein the flow controlling orifice device includes a predetermined plurality of orifices with at least one of the orifices located outwardly of the top ring turn around position on the annular cylinder liner.

6. The engine cooling system of claim 5, wherein the plurality of orifices are arranged in rows to define an array having a predetermined height and a predetermined width.

7. The engine cooling system of claim 6, wherein the predetermined circumferential width of the plurality of orifices directing cooling liquid for impingement on the predetermined portion of the annular cylinder liner is not more than about 180 degrees.

8. The engine cooling system of claim 7, wherein the predetermined height of the array of orifices has an innermost row of orifices located axially inwardly of the top ring turn around position by no more than about 15 mm.

9. The engine cooling system of claim 7, wherein the array of orifices has a minimum height of about 8 mm and a maximum height of about 80 mm.

10. The engine cooling system of claim 6, wherein the cooling liquid flow path includes an outlet port in the cylinder housing.

11. The engine cooling system of claim 10, wherein the outlet port is located substantially diametrically opposite the array of orifices in the flow restricting orifice device and the cooling liquid flow path includes two segments, each communicating between the flow controlling orifice device and the outlet port.

12. The engine cooling system of claim 11, wherein the cross sectional area of the outlet port is substantially equal to the combined cross sectional areas of the cooling liquid flow path segments communicating therewith.

13. The engine cooling system of claim 12, wherein the exhaust port includes a valve seat located substantially at the point of intersection with the combustion chamber, a valve seat cooling liquid flow path defined by the cylinder head in circumjacent relationship to the valve seat and in communication with the cooling liquid flow path.

14. The engine cooling system of claim 13, wherein the cylinder head defines additional cooling liquid passages in communication with the valve seat cooling liquid flow path and the outlet port.

15. The engine cooling system of claim 12, wherein the cylinder head is separate from the cylinder housing and is secured thereto, the head defining additional cooling liquid passages for directing cooling liquid therethrough with a gasket located between the cylinder head and the axially outermost end of the cylinder housing, an opening is defined in the gasket for communication between the cooling liquid inlet chamber and the additional cooling liquid passages.

16. The engine cooling system of claim 5, wherein the flow controlling orifice device is a ring member mounted in the cylinder housing in radially spaced, circumscribing relation to the annular cylinder liner to define therewith the cooling liquid flow path.

17. The engine cooling system of claim 16, wherein the cooling liquid flow path includes an outlet port in the cylinder housing and the ring member is substantially concentric with the annular cylinder liner such that the cross sectional area of the cooling liquid flow path is substantially equal therearound.

18. The engine cooling system of claim 17, wherein the ring member has an opening in substantial circumferential alignment with the outlet port in the cylinder housing.

19. The engine cooling system of claim 5, wherein the flow controlling orifice device is an arcuate member secured to the cylinder housing in substantial blocking relation so that communication from the cooling liquid inlet chamber to the cooling liquid flow path is only through the orifices.

20. The engine cooling system of claim 5, wherein the portion of the flow controlling orifice device directing cooling liquid for impingement on the predetermined peripheral portion of the annular cylinder liner provides the only communication between the cooling liquid inlet chamber and cooling liquid flow path.

21. The engine cooling system of claim 1, wherein a protuberance operatively associated with one of the cylinder housing and the annular cylinder liner projects into the cooling liquid flow path at a predetermined location downstream of the cooling liquid inlet chamber to reduce the predetermined cross sectional area of the cooling liquid flow path thereat.

* * * * *